US005139239A

United States Patent [19]

Eccleston

[11] Patent Number: 5,139,239

[45] Date of Patent: Aug. 18, 1992

[54] LINING OF MOLTEN METAL HANDLING VESSELS

[75] Inventor: Kenneth T. Eccleston, Walsall, England

[73] Assignee: Foseco International Limited, Birmingham, England

[21] Appl. No.: 745,248

[22] Filed: Aug. 14, 1991

[51] Int. Cl.[5] ..... C21B 3/00

[52] U.S. Cl. ..... 266/275; 266/280; 266/281

[58] Field of Search ..... 266/275, 280, 281

[56] References Cited

U.S. PATENT DOCUMENTS

| | | | |
|---|---|---|---|
| 4,076,224 | 2/1978 | Duchateau | 266/280 |
| 4,222,522 | 9/1980 | Kubo | 266/281 |
| 4,422,625 | 12/1983 | Thurn | 266/275 |
| 4,779,798 | 10/1988 | Natolino | 266/281 |

FOREIGN PATENT DOCUMENTS

| | | |
|---|---|---|
| 180388 | 5/1986 | European Pat. Off. . |
| 1558588 | 1/1973 | Fed. Rep. of Germany . |
| 2112581 | 6/1974 | Fed. Rep. of Germany . |
| 1364665 | 8/1974 | United Kingdom . |
| 1537739 | 1/1979 | United Kingdom . |
| 2080505 | 2/1982 | United Kingdom . |
| 2104633 | 3/1983 | United Kingdom . |

*Primary Examiner*—Peter D. Rosenberg
*Attorney, Agent, or Firm*—Nixon & Vanderhye

[57] ABSTRACT

The invention relates to the provision of an expendable inner lining (13) over the relatively permanent refractory lining (11) of a molten metal handling vessel (10), in which venting means (25) are provided to aid venting and drying of the slurry from which the expendable lining is formed.

Strips (12) of removable material are applied to the surface of the permanent lining (11) and the slurry is applied over the strips and over the remainder of the surface of the permanent lining. After drying of the slurry, the strips (12) are removed to leave vent channels (25).

The removable strips may be of heat-consumable material so that they are destroyed by heating. Alternatively they may be removable and re-usable.

20 Claims, 4 Drawing Sheets

FIG.6.
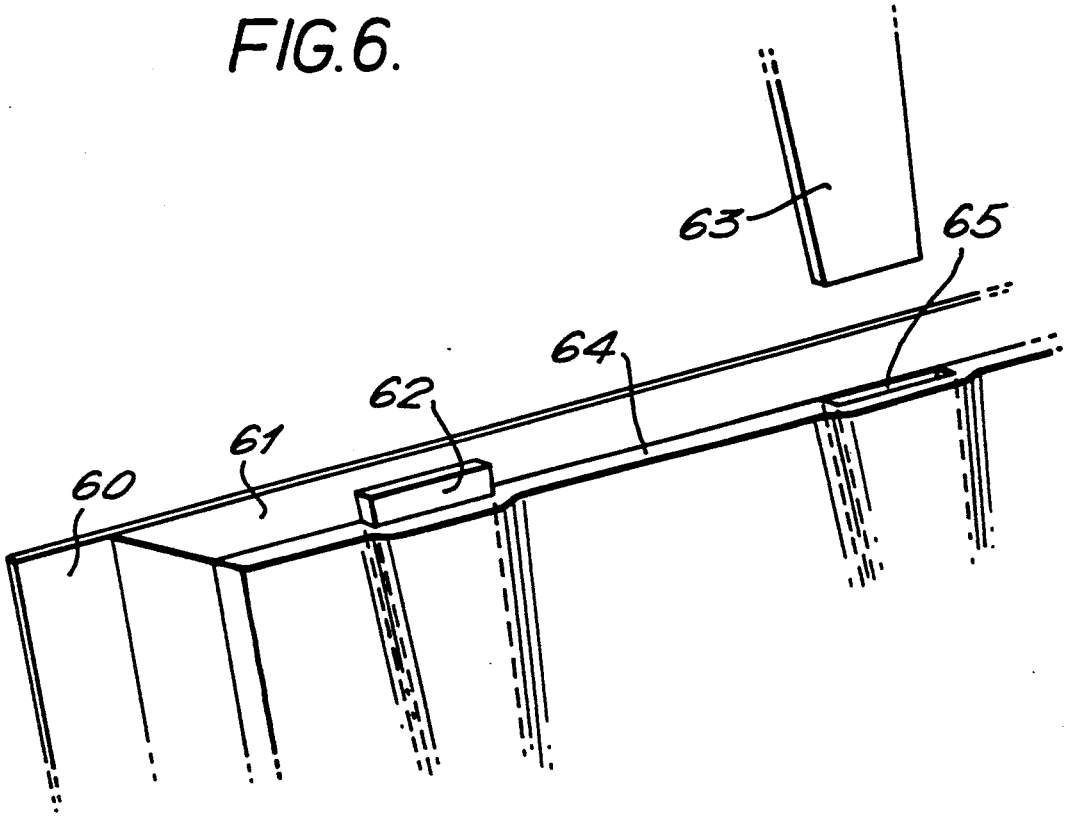
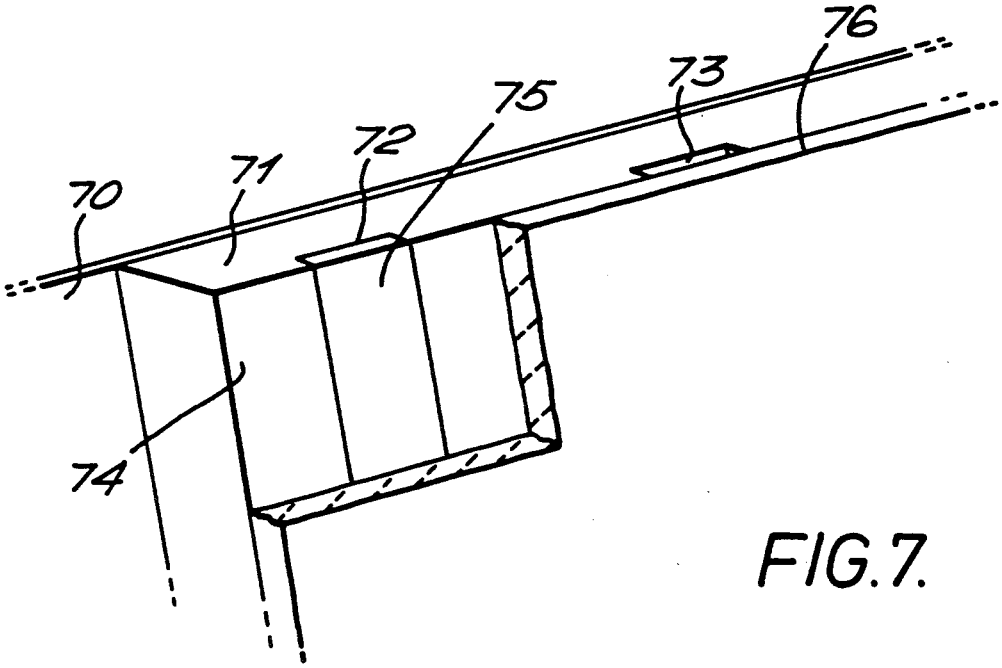
FIG.7.

LINING OF MOLTEN METAL HANDLING VESSELS

This invention relates to the lining of molten metal handling vessels, for example, a tundish or a ladle. For convenience the invention will be described with specific reference to tundishes.

In the continuous casting of metals, e.g. steel, molten metal is cast into a continuous casting mould via an intermediate vessel which acts as a constant head reservoir, this intermediate vessel being known as a tundish. The tundish has a metal floor and walls and one or more outlet nozzles set in the floor. To protect the metal floor and walls of the tundish from the effects of the molten metal it is usual to line the interior of the tundish with a relatively permanent lining, often made of bricks or in the form of a cast monolithic lining. The tundish may additionally be provided with an inner expendable lining of refractory heat-insulating material.

Expendable inner linings have to meet various distinct requirements and certain of these conflict to a greater or lesser extent. In particular, while it is desirable for the expendable lining to be highly heat-insulating, it is also desirable for it to have substantial resistance to erosion by molten metal and slag. However, any change in the nature of the lining that improves its heat-insulating properties is usually associated with a reduction in its density, which tends also to result in reduced erosion-resistance.

Thus, a number of prior proposals have been made for the provision of an expendable lining in a tundish.

GB 1364665 describes the provision of an expendable lining in the form of refractory, heat-insulating slabs.

GB 2080505 describes an inner expendable lining of refractory, heat-insulating slabs having an inward-facing, erosion-resistant layer and a more heat-insulating backing layer.

EP 0180388 describes the use of a parting layer of heat-carbonisable sheet material between the permanent and expendable lining.

It has also been proposed to apply the expendable lining directly on to the permanent lining by trowelling, gunning or spraying rather than fitting pre-formed slabs over the permanent lining.

The present invention aims to provide an improved expendable lining system.

Accordingly, in one aspect the invention provides a method of forming an expendable lining in a molten metal handling vessel having an outer metal casing lined with a relatively permanent lining, in which portions of the surface of the permanent lining are covered with a removable material, a slurry of refractory material is applied over both the removable material and the remaining exposed surface of the permanent lining, the slurry is dried to form the expendable lining and the removable material is removed to leave gaps between the expendable lining and the permanent lining, the gaps providing vent channels for gases. The gaps act as venting means during further drying and use of the vessel with attendant advantages as discussed in more detail below.

The removable material may conveniently be in the form of strips of consumable material, for example, of cardboard, strawboard, fibreboard or polystyrene, which may be in corrugated form. Alternatively, it may be in the form of a consumable cellular material, e.g. polyurethane foam. Where such boards are used, their surfaces to contact the slurry may be roughened, castellated or otherwise treated to improve the adhesion to the slurry.

In an alternative embodiment, the removable material may be in the form of re-usable formers that are placed in the desired positions prior to application of the slurry layer and may be removed afterwards. Such formers may be of any suitable material, e.g. metal or wood or they may be inflatable. If desired, formers of, for example, metal or wood, may be covered with a refractory sleeve or coating so as to aid removal of the former after the expendable slurry layer has been formed.

It will readily be appreciated that the insertion and removal of formers can be mechanised, if desired.

In a further embodiment, the permanent lining may be formed with recesses corresponding to the desired vent channels. This can most conveniently be achieved during the formation of a cast permanent lining. These recesses are then filled by the insertion of corresponding removable formers. After application and setting of the slurry layer, the formers are removed to leave vent channels provided by the recesses.

The removable layer is preferably applied in strip form to the permanent lining so as to leave gaps between the strips, which are aligned vertically on the permanent lining, although differently-angled alignments may be used if desired. Where a consumable layer is used, it may have a series of holes through its thickness, for example, it may be of honeycomb structure. It will be appreciated, therefore, that when the slurry is applied over the consumable layer, it will penetrate the holes to contact the permanent lining and thereby effect adhesion of the expendable lining to the permanent lining in those regions in addition to any portions of the permanent lining surface not covered by the consumable layer.

The consumable layer may be held in place against the permanent lining by clips or adhesion pads or any other convenient means.

In another aspect, the invention provides a molten metal handling vessel having an outer metal casing lined with a relatively permanent lining and an inner expendable lining formed from a slurry of refractory material directly adhered to the permanent lining at a number of locations and separated from the permanent lining at other locations by air gaps which provide vent channels for gases.

The slurry is preferably applied over the consumable lining by spraying although gunning or trowelling could be used, if desired.

Where a consumable layer is used it may conveniently be burned out during the drying and preheating of the lined vessel. Temperatures of up to about 600° C. may conveniently be employed in the preheating step although higher temperatures up to about 900° C. may be used, if desired. However, depending on the material and thickness used, it is possible that a consumable layer will not be burned out completely by pre-heating but will be finally removed during actual use of the vessel, i.e. from the heat of the molten metal.

The invention provides a number of advantages over a conventionally-sprayed lining, i.e. one which is sprayed directly onto the permanent lining of the vessel. Such conventional sprayed linings, while having some benefits, particularly in ease and convenience of application, do also have certain disadvantages.

The direct application of the sprayed lining to the permanent lining eliminates air gaps between the two which reduces thermal insulation, this manifesting itself in greater heat build-up in the vessel.

Drying of the sprayed lining can take a relatively long time and this can result in insufficient drying and unwanted moisture remaining in the expendable lining.

Unwanted build-up of gas from the lining may also occur.

De-sculling of the vessel can be troublesome because of the direct attachment over substantially the whole surface area of the permanent lining. This can lead to damage of the permanent lining which then requires repair.

These problems are largely avoided by the present invention. Drying and pre-heating can be quicker and more uniform in effect and gases generated from the expendable lining will be provided with a more direct route to the atmosphere via the vent channels provided by the air gaps resulting in reduced gas build up in the shell of the vessel. Improved thermal insulation is also provided. De-sculling is simplified due to the reduced contact between the linings.

The expendable linings of the invention are preferably of thickness from 20 to 50 mm including the portions contacting the permanent lining. The air gaps between the permanent and expendable linings are preferably from 3 to 20 mm thick when consumable layers have been used, i.e. corresponding to the use of consumable layers of that thickness. However, bigger gaps may be formed where re-usable formers are used, or indeed, where a hollow consumable layer is used. For example, in these circumstances, gaps of 200 mm or higher thickness may be employed.

The width of the air gaps, their numbers and spacing and thickness will vary with the specific conditions to be encountered in the use of a particular vessel but will be readily determinable by the skilled man of the art.

If desired, the gaps may be filled with a coarse particulate material to provide support for the expendable lining. By this means larger gaps may be utilised while the nature of the particulate filling still enables adequate venting to take place.

The invention is further illustrated by way of example only with reference to the accompanying drawings in which:

FIG. 6 is a perspective view with parts cut away of a portion of a tundish lined using re-usable formers;

FIG. 7 is a similar view of FIG. 6 but showing an embodiment utilising recesses formed in the permanent lining;

Figure 1:
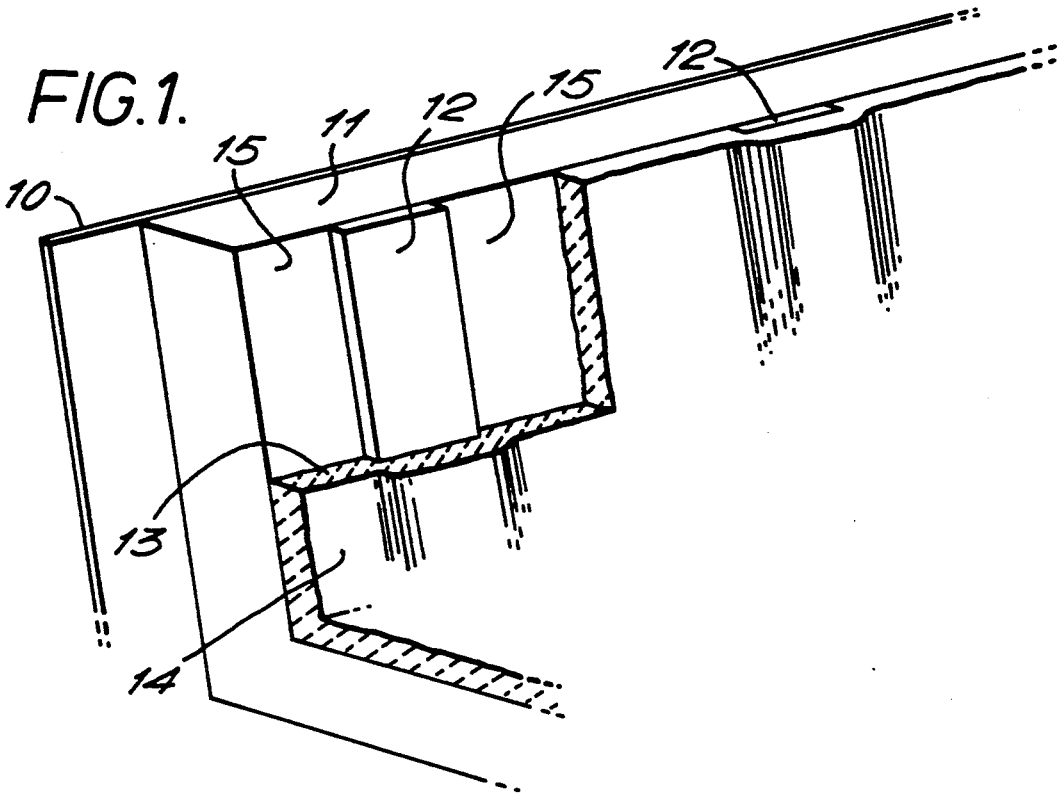
FIG. 1 is a perspective view with parts cut away of a portion of a tundish lined according to one embodiment of the invention.

FIG. 1 illustrates an embodiment in which strips of consumable board are applied in spaced rows over the permanent lining of a tundish. The metal casing 10 of a tundish has a permanent lining 11 of monolithic construction. Strips 12 of consumable board are attached in rows to the monolithic lining 11. An expendable lining 13 is formed by spraying an aqueous slurry of refractory material over the strips 12 and over the permanent lining 11 between the strips 12 and then drying. The expendable lining 13 has a stepped inner surface 14 to contact molten metal in the tundish and fills the gaps 15 that lie between the strips 12.

Strips 12 are burned out during pre-heating of the tundish to about 600° C. and leave corresponding air gaps (not shown) in the form of vertical channels between permanent lining 11 and expendable lining 13.

Figure 2:
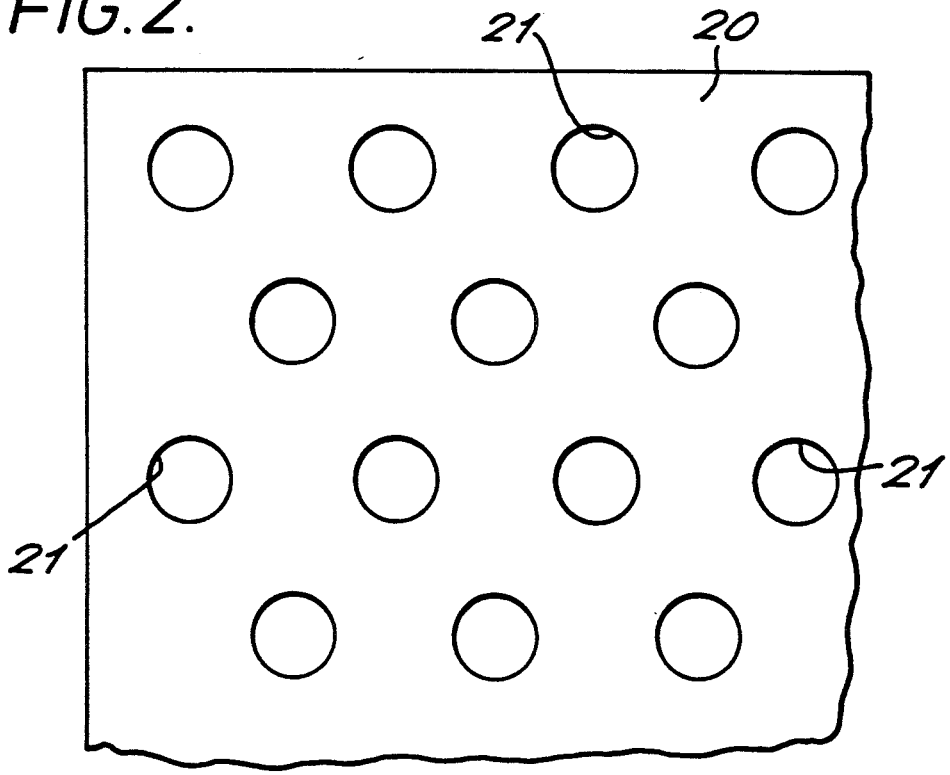
FIG. 2 is a plan view of a board suitable for use as a consumable layer according to another embodiment of the invention.

In FIG. 2, a board 20 of, say, corrugated cardboard is provided with a plurality of holes 21 through its thickness. This board is then attached to the permanent lining of a tundish and a layer of aqueous slurry of refractory material is sprayed over the board. The layer so deposited is then dried and the tundish heated to burn out the board 1.

Figure 3:
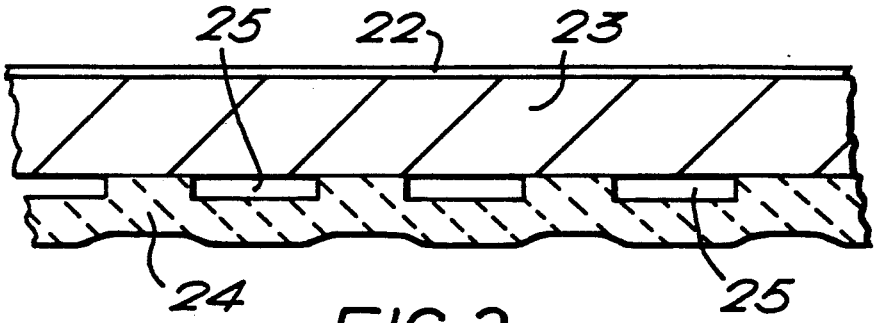
FIG. 3 is a horizontal section through a portion of a wall of a tundish lined using the board of FIG. 2.

The resulting construction is shown in FIG. 3. The metal casing 22 of a tundish has a permanent lining 23 of monolithic construction, known per se in the art. Over the permanent lining 23 is an expendable lining 24 formed from the sprayed-on slurry of refractory material. Lining 24 contacts and adheres to permanent lining 23 at locations 26 that correspond to the holes 21 in the consumable board 20. Interconnected air gaps 25 between expendable lining 24 and permanent lining 23 correspond to the body of board 20 that is burned out and provide vent channels for escape of gas.

(It will be appreciated that in a further embodiment the board with holes through may be applied in strip form with gaps between the strips.)

Figure 4:
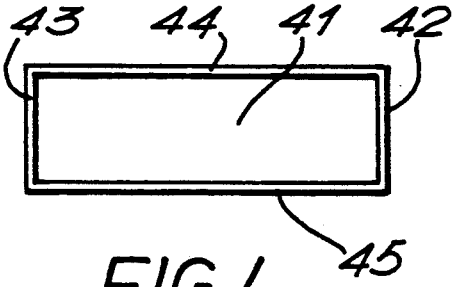
FIGS. 4 and 5 are an end view and a front view respectfully of a hollow consumable layer, FIG. 4 being a view along arrow A of FIG. 5.
Figure 5:
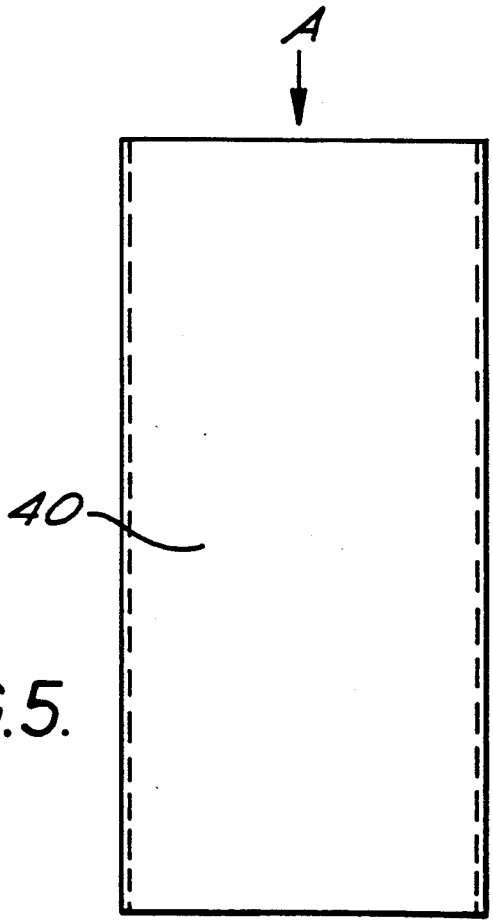

FIGS. 4 and 5 show a strip 40 of consumable material that is of hollow rectangular section having a central cavity 41 defined by walls 42, 43, 44 and 45 of the consumable material.

FIG. 6 illustrates an embodiment in which re-usable formers are positioned on to the permanent lining of a tundish. The metal casing 60 of a tundish has a permanent lining 61 of monolithic construction. A series of re-usable formers of which two, 62 and 63 are shown, is positioned against lining 61 to form a spaced row of vertically-extending removable strips. The formers taper so that they are wider adjacent the top of lining 61 and narrower at their lower ends when positioned in the tundish. This renders their extraction easier. An expendable lining 64 is formed by spraying an aqueous slurry of refractory material over the formers and over the permanent lining between the formers and then drying. The formers can then be removed to leave vent channels between permanent lining 61 and expendable lining 64. Former 63 is shown having been removed to leave vent channel 65 whereas former 62 is shown only partially extracted.

In FIG. 7 a tundish has a metal casing 70 with a permanent monolithic cast lining 71 which has been formed with a series of vertically-extending recesses 72, 73 in its inner face 74. The recesses are each filled with a re-usable or consumable former 75, and then an expendable lining 76 is formed by spraying an aqueous slurry of refractory material over the exposed face 74 of the permanent lining and over the formers 75 and then drying. The formers are then removed to leave vent channels. The drawing shows one former having been removed to leave a vent channel corresponding to recess 73 with another former still to be removed.

Figure 8:
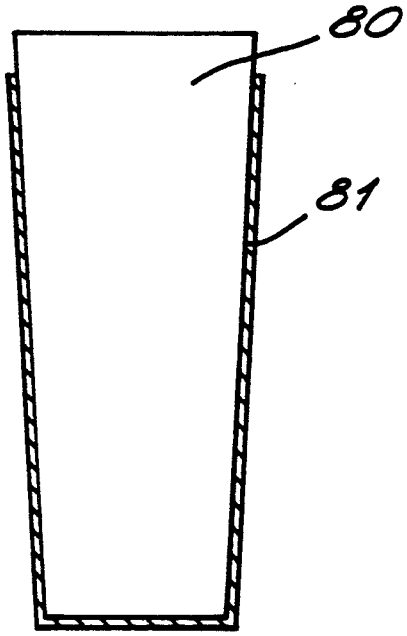
FIG. 8 is a vertical sectional view of a reusable former in a sleeve of refractory material.

FIG. 8 shows a tapered re-usable former 80 contained in a sleeve 81 of refractory material.

Figure 9:
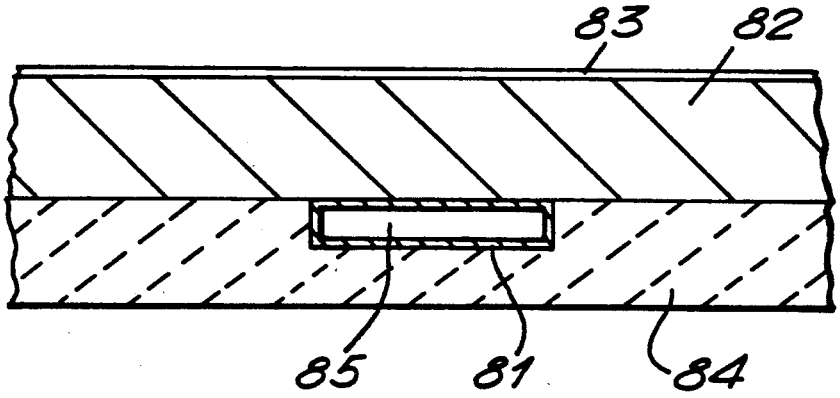
FIG. 9 is a horizontal section through a wall of a tundish lined using the former of FIG. 8.

This sleeved former is placed vertically against the face of a permanent lining 82 of a tundish having a metal casing 83. A series of such sleeved formers is used spaced along the inside walls of the lined tundish. The walls are then sprayed as described above to form an expendable lining 84. When the lining 84 is adequately dried, the formers are removed to leave cavities or vent channels 85 lined with the refractory sleeves 81 as shown in FIG. 9.

I claim:

1. A method of forming an expendable lining in a molten metal handling vessel, comprising the steps of:
   - providing a vessel having an outer metal casing lined with a relatively permanent lining;
   - applying a slurry of refractory material to a surface of the permanent lining to form an expendable lining, to come into contact with molten metal when the molten metal is placed in the vessel;
   - drying the slurry of refractory material;
   - covering portions of the surface of the permanent lining with a removable material prior to applying the slurry to both the removable material and any remaining exposed surfaces of the permanent lining; and
   - removing the removable material after drying of the slurry to leave gaps between the expendable lining and the permanent lining, so that the gaps provide vent channels for gases.

2. A method according to claim 1, in which the removable material is applied in the form of strips of heat-consumable material.

3. A method according to claim 2, in which the heat-consumable strips are hollow.

4. A method according to claim 2, in which the strips of heat-consumable material are consumed during the pre-heating stage of use of the vessel.

5. A method according to claim 2, in which the strips of heat-consumable material are formed with a series of holes through their thickness whereby the slurry penetrates the holes to contact the permanent lining.

6. A method according to claim 1, in which the removable material is applied in the form of re-usable, extractable, formers.

7. A method according to claim 1, in which the permanent lining is formed with recesses corresponding to the desired vent channels, these recesses are filled with removable formers, the slurry layer is applied and dried and the formers are then removed.

8. A method according to claim 7, in which the permanent lining is a monolithic cast lining.

9. A method according to claim 6, in which the re-usable formers are provided with a covering sleeve of refractory material.

10. A method according to claim 1, in which the gaps providing vent channels extend vertically in the vessel.

11. A method according to claim 1, in which the slurry is applied to the permanent lining by spraying.

12. A molten metal handling vessel, comprising:
   - a vessel having an outer metal casing lined with a relatively permanent lining and an inner expendable lining, said inner expendable lining being formed from a slurry of refractory material; and
   - wherein, said expendable lining is connected to the permanent lining at a number of locations and is separated from the permanent lining at a number of other locations by air gaps which provide vent channels for gases.

13. A molten metal handling vessel according to claim 12, in which the vent channels extend vertically.

14. A molten metal handling vessel according to claim 12 or 13, in which the vent channels are provided by recesses in the permanent lining.

15. A molten metal handling vessel according to claim 12, in which the vent channels are filled with coarse particulate material.

16. A method of manufacturing a molten metal handling vessel, comprising the steps of:
   - providing a vessel having an outer shell with a protective lining disposed internally thereof, the protective lining having an exposed surface;
   - positioning a discontinuous pattern of consumable material along the exposed surface of the protective lining, so as to create a second surface having alternating intervals of exposed surface of the protective lining and consumable material;
   - applying a refractory material to the second surface;
   - drying the refractory material; and
   - removing the consumable material from the vessel so that at least one passageway is created between the protective lining and the refractory material in order to allow gas to escape.

17. A method according to claim 2, wherein the strips of said removable material is selected from the group consisting essentially of cardboard, strawboard, fiberboard and polystyrene.

18. A method according to claim 1, wherein said removable material is a consumable cellular material.

19. A method according to claim 1, wherein said removable material is secured to the permanent lining.

20. A method according to claim 15, wherein the protective lining is provided with recesses which correspond to a position in which the passageway is to be formed.

* * * * *